United States Patent [19]

Mulloy

[11] 4,041,893

[45] Aug. 16, 1977

[54] MEDICAL REFERENCE CHART

[76] Inventor: Edward B. Mulloy, 1434 Argyle Drive, Fort Myers, Fla. 33901

[21] Appl. No.: 671,327

[22] Filed: Mar. 29, 1976

[51] Int. Cl.[2] ..... G09F 9/00

[52] U.S. Cl. ..... 116/131; 116/133; 116/135; 128/1 R

[58] Field of Search ..... 116/131, 121, 135, 133, 116/130; 35/74, 75; 40/62, 70 R; 128/1 R

[56] References Cited

U.S. PATENT DOCUMENTS

| | | | |
|---|---|---|---|
| 623,171 | 4/1899 | Mowry | 116/121 |
| 1,131,314 | 3/1915 | Bedell | 40/70 R |
| 1,659,748 | 2/1928 | Sargent | 116/131 |
| 3,087,457 | 4/1963 | Prosen | 116/135 |
| 3,270,709 | 9/1966 | Berge | 116/135 |
| 3,397,434 | 8/1968 | Arblaster | 116/135 |

FOREIGN PATENT DOCUMENTS

| | | | |
|---|---|---|---|
| 1,937 | 1/1894 | United Kingdom | 116/121 |

*Primary Examiner*—S. Clement Swisher
*Assistant Examiner*—Denis E. Corr
*Attorney, Agent, or Firm*—Alfred E. Wilson

[57] ABSTRACT

This invention pertains to a chart for use in hospitals and nursing homes, for example, to indicate the next procedure to be taken in the continuing care of a patient. The device consists of a flat sheet of a relatively rigid material including two vertical slots, adjacent the respective side edges thereof, with associate linear slide member indicators, a horizontal groove and linear slide member indicator, and upper and lower rotary indicators; the various linear and one rotary indicator being operable to indicate the various procedures, the other of said rotary indicators being designed to indicate the time of a particular procedure.

2 Claims, 2 Drawing Figures

MEDICAL REFERENCE CHART

OBJECTS AND ADVANTAGES OF THE PRESENT INVENTION

One of the principal objects of the present invention is to provide a chart for use in a hospital or nursing home, for example, which includes a first slot and slide member to indicate the next procedure to be taken in the continuing care of a patient.

Another principal object of this invention is to provide a second slot and associated slide member to indicate the performance of the procedure by the hospital or nursing home personnel.

A further object of the instant invention is to provide a third slot and associated slide member to indicate the location on a patients body of the administration of the last procedure, such as an injection.

A further object of this invention is to provide a first rotary indicator to record the last position that the patient was turned to, and a second rotary indication to record the time A.M. or P.M. that the patient was turned to that position.

Yet another object of the present invention is to provide means to hang the chart on the foot portion of the patients bed and additional means to permit the chart to be permanently secured to the foot of the bed to discourage the patient from tampering with it.

DETAILED DESCRIPTION OF THE DRAWINGS

Figure 1:
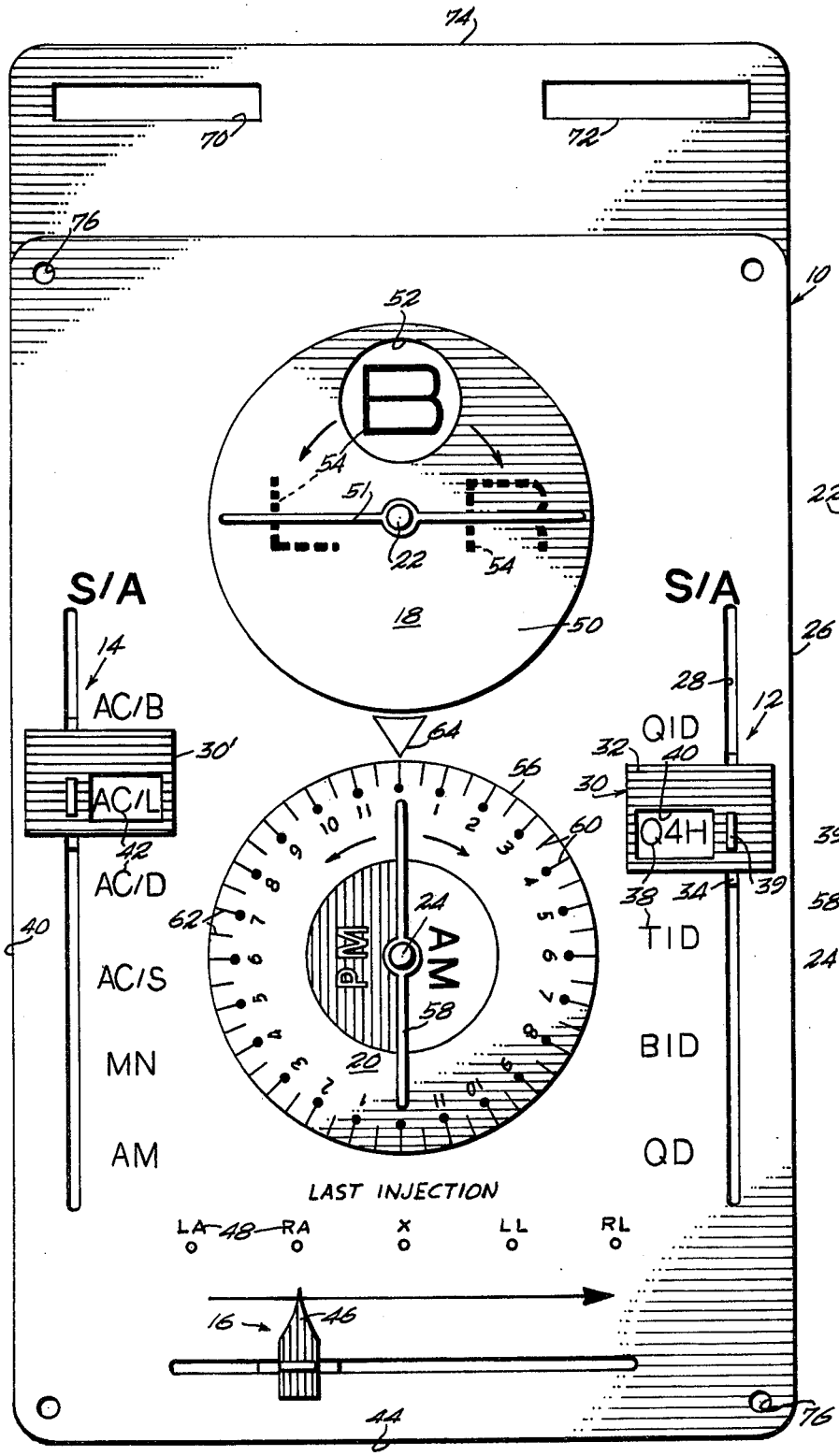
FIG. 1 is a face view of the chart of the present invention.

With reference to the drawings in which like reference characters designate like or corresponding parts in both of the views, and as best illustrated in FIG. 1, it comprises a relatively rigid sheet of plastic or other material 10 with first and second linear indicator means 12 and 14 adjacent the respective side edges thereof, a third linear indicator means 16, laterally disposed adjacent its bottom edge, and first and second rotary indicator means 18 and 20, pivotally attached at 22 and 24 in a spaced apart relation along the central portion of sheet 10.

The first linear indicator means 12 is located inwardly of and in a generally parallel relation to the first side edge 26 of sheet 10. Indicator means 12 is generally comprised of an elongated slot 28 with a slide member 30, slidably disposed therethough. Slide member 30 includes an enlarged outer portion 32 overlying the face of sheet 10 and an enlarged retainer portion 34 in sliding engagement along the back side of sheet 10. Preferably the retainer portion 34 is slidably engaged in a groove 36 formed in the back side of sheet 10, and may be in the form of a spring leaf to frictionally maintain the slide member against slippage or accidental movement. The structure as above described can be modified in various ways to accomplish the same purposes.

Inwardly of the slot 28 a plurality of spaced apart, aligned indicia markings 38 are applied to the face of sheet 10 and a sight window 40 is provided in enlarged outer portion 32 for selective alignment with the various indicia markings 38 which indicate the next procedure, treatment, etc to be taken in the continuing care of a patient. A finger grip tab 39 extends outwardly from the enlarged outer portion 32 of slide member 30.

The second linear indicator means 14, adjacent a second side edge 40 of sheet 10, is similar in all respects to first linear indicator means 12 and will not be further described. Indicia markings 42 associated therewith selectively indicate the performance of the procedure, treatment, etc ordered by the doctor on the first linear indicator means 12.

Third linear indicator means 16 is laterally disposed adjacent the bottom edge 44 of sheet 10 and is similar in all respects to the first and second linear indicator means except that the enlarged outer portion 32 is replaced by a pointer 46 which is selectively slidable into registeration with any of the aligned indicia markings 48.

The first rotary indicator means 18 comprises a disc 50, manually operable about pivot 22 by an outwardly extending fin 51. A sight window 52, provided in disc 50, is selectively movable into registeration with any of a plurality of indicia markings 54, applied to the face if sheet 10, to indicate the position to which the patient was turned.

The second rotary indicator means 20 comprises a disc 56, manually operable by an outwardly extending fin 58 and including indicia in the form of 12 hour A.M. and P.M. markings as indicated at 60 and 62. Second rotary indicator 20 is rotatable relative to a reference pointer 64 applied to the face of sheet 10 to indicate for example the exact time that the patient was turned.

For example, in the treatment of diabetes, the sugar and acitone test to be taken according to the orders established by the doctor is indicated in the indicia column 38. The hospital or nursing home personnel administering the care of a patient would then perform the test to be undertaken and would indicate that this procedure had been performed by moving the slide member 30' to a proper position as determined by the indicia column 42.

The indicia markings 48 associated with the third linear indicator means 16 indicate the various injection positions on the body of a patient. Pointer 46 is operable to indicate the position of the last injection. RA for example, indicate that the last injection was applied in the right arm. As it is desirable to rotate the injection positions, the chart of the present invention enables the person administering the injection to simply and accurately record the injection locations in a sequential order.

Figure 2:
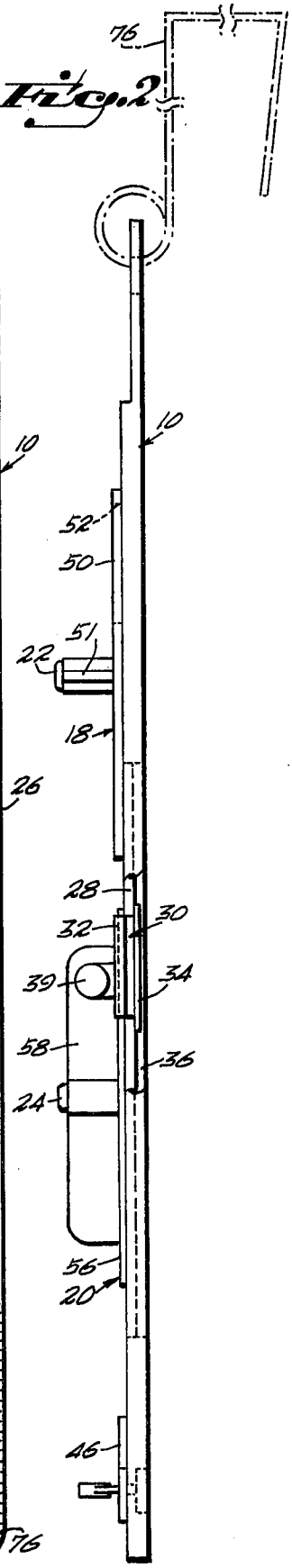
FIG. 2 is a side edge view thereof with parts broken away to better illustrate the invention.

A pair of spaced apart apertures 70 and 72 are formed in the sheet adjacent the upper edge 74 for the reception of a hanger member 76 illustrated in broken lines in FIG. 2, corner holes 76 are formed in the sheet 10 for the reception of permanent fastening means such as screws or bolts.

I claim:

1. A reference chart for use in hospitals and nursing homes or the like comprising, a relatively rigid sheet of any suitable material, generally rectangular in shape and including, a first indicator means for selective, manual operation to indicate the next procedure to be taken in the continuing care of a patient, a second indicator means for selective manual operation to indicate the performance of said procedure, a third indicator means for selective manual operation to indicate the portion of a patient's body to which said procedure was administered, said first, second and third indicator means being linear in form, a first rotary indicator means for selective, manual operation to indicate the last position to which a patient was turned in bed, said first rotary indicator means comprising a first disc, centrally pivoted to the upper, central portion of said sheet with a sight window therethrough, and an outwardly extending finger grip portion for manual rotation thereof into selective registration with any one of a plurality of indicia markings applied to the face of said sheet.

2. A reference chart for use in hospitals and nursing homes or the like comprising, a relatively rigid sheet of any suitable material, generally rectangular in shape and including, a first indicator means for selective, manual operation to indicate the next procedure to be taken in the continuing care of a patient, a second indicator means for selective manual operation to indicate the performance of said procedure, a third indicator means for selective manual operation to indicate the portion of a patient's body to which said procedure was administered, said first, second and third indicator means being linear in form, a first rotary indicator means for selective, manual operation to indicate the last position to which a patient was turned in bed, and including a second rotary indicator means for selective, manual operation to indicate the time, A.M. or P.M., that the patient was turned, and wherein said second rotary indicator means comprises a second disc, centrally pivoted to the lower central portion of said sheet, indicia in the form of 12 A.M. and P.M. hour markings disposed about peripheral edge portion of said disc, a reference pointer applied to said sheet face, and an outwardly extending finger grip from said disc for manual rotation thereof to provide for selective alignment of any said hour markings with said reference pointer.

* * * * *